US010143048B2

(12) United States Patent
Hierzer

(10) Patent No.: US 10,143,048 B2
(45) Date of Patent: Nov. 27, 2018

(54) LED LIGHT WITH CONTROL CIRCUIT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 76 days.

(21) Appl. No.: 15/287,929

(22) Filed: Oct. 7, 2016

(65) Prior Publication Data

US 2017/0105254 A1 Apr. 13, 2017

(30) Foreign Application Priority Data

Oct. 7, 2015 (DE) ..... 10 2015 219 367

(51) Int. Cl.
*H05B 33/08* (2006.01)

(52) U.S. Cl.
CPC ..... *H05B 33/0815* (2013.01)

(58) Field of Classification Search
CPC ..... H05B 37/02; H05B 37/0227; H05B 37/0272; H05B 37/03; H05B 33/08; H05B 33/0815; H05B 33/0845; H05B 33/0881
USPC ..... 315/129–134, 150–152, 291, 294, 307, 315/308, 312
See application file for complete search history.

(56) References Cited

U.S. PATENT DOCUMENTS 9,055,648 B2 6/2015 Kondo et al.
2011/0068706 A1 3/2011 Otake et al.
2011/0127923 A1* 6/2011 Lin ..... H05B 33/0815 315/193
2012/0280617 A1 11/2012 Josefowicz et al.
2012/0286668 A1 11/2012 Kondo et al.
2013/0169171 A1 7/2013 Kamizono et al.
2013/0200812 A1 8/2013 Radermacher et al.
2014/0265931 A1 9/2014 Greenwood
2015/0022106 A1 1/2015 Chiu
2015/0245441 A1 8/2015 McCune, Jr.
2015/0373796 A1* 12/2015 Bahrehmand ..... H05B 33/0815 315/129

(Continued)

FOREIGN PATENT DOCUMENTS

DE 102004033980 A1 2/2006
DE 102008033176 A1 1/2010
DE 102008058524 A1 5/2010

(Continued)

OTHER PUBLICATIONS

English Abstract of DE 102004033980 A1 published Feb. 16, 2006.

(Continued)

*Primary Examiner* — Jimmy Vu
(74) *Attorney, Agent, or Firm* — Millen, White, Zelano & Branigan, P.C.; William Nixon

(57) ABSTRACT

A control circuit for a voltage converter has a switch which has a multiplicity of parallel-connected current-conducting branches with resistors with different resistance values, and a contact maker. The contact maker is configured to connect selectively in each case one of the multiplicity of parallel-connected current-conducting branches to an input contact of the switch. The control circuit also includes a detector circuit which is configured to determine a voltage drop across the resistors and to output, as a function of the determined voltage drop, an actuation signal for setting a setpoint output current of the voltage converter to the voltage converter.

16 Claims, 2 Drawing Sheets

(56) References Cited

U.S. PATENT DOCUMENTS

2015/0377437 A1 12/2015 Austerer

FOREIGN PATENT DOCUMENTS

| | | | |
|---|---|---|---|
| DE | 102010005504 | A1 | 7/2011 |
| DE | 102010025082 | A1 | 12/2011 |
| DE | 102014109466 | A1 | 7/2015 |
| DE | 202014102007 | U1 | 9/2015 |
| DE | 102014221360 | A1 | 4/2016 |
| EP | 2 496 057 | A1 | 9/2012 |
| EP | 2706819 | A1 | 3/2014 |
| WO | 2013159131 | A1 | 10/2013 |
| WO | 2014124831 | A1 | 8/2014 |

OTHER PUBLICATIONS

English Abstract of DE 102008033176 A1 published Jan. 21, 2010.
English Abstract of DE 102008058524 A1 published May 27, 2010.
English Abstract of DE 102010005504 A1 published Jul. 28, 2011.
English Abstract of DE 102010025082 A1 published Dec. 29, 2011.
English Abstract of DE 102014109466 A1 published Jul. 23, 2015.
English Abstract of DE 102014221360 A1 published Apr. 21, 2016.
English Abstract of DE 202014102007 U1 published Sep. 10, 2015.
European Search Report issued in corresponding EP 16 19 2574 dated Jan. 20, 2017.
Austrian Search Report issued in corresponding AT 517758 A2 dated May 4, 2018.

* cited by examiner

LED LIGHT WITH CONTROL CIRCUIT

TECHNICAL FIELD OF THE INVENTION

The invention relates to a control circuit for setting an output current of a voltage converter and to a light having such a control circuit, in particular for use in lights with LED lighting means.

TECHNICAL BACKGROUND

Electrical light sources are operated with supply voltages and supply currents which are usually adjusted to the type and characteristics of the light sources. Specifically in the case of light-emitting diodes (LEDs) this adjustment is frequently implemented by means of converter circuits which rectify an input AC voltage into a supply DC voltage with a predetermined DC intensity. The power consumption and therefore the brightness can be set by means of the level of the controllable DC intensity in the case of LEDs. Converter circuits with a controllable constant current control the output current intensity in such a way that the operating current of one or more operated LED modules is in the optimum range.

Typically, the setpoint value of the output current intensity in conventional converter circuits for lights with LED lighting means is preset at the works. As a result, the brightness of the light is invariable. Various approaches in the prior art attempt to provide room for manoeuvre in the selection of the brightness of the LEDs for a user of such LED lights: document WO 2010/021675 A1 discloses, for example, an LED light with a converter circuit which is integrated into the socket and whose output current intensity can be controlled by means of a switching mechanism which is also integrated into the socket. Document DE 10 2010 002 996 A1 discloses a lighting arrangement having an LED light and a socket into which an operator control element for setting lighting properties of the LED light is integrated.

SUMMARY OF THE INVENTION

One of the ideas of the invention is therefore to find solutions for actuating voltage converters in which the setpoint output current can be adapted flexibly. A further idea of the invention is also to find easy-to-implement solutions for lights with LED lighting means in which the brightness of the LED lighting means can be set flexibly and without a large amount of installation expenditure.

According to a first aspect of the invention, a light comprises a lighting means carrier, at least one LED lighting means which is arranged on the lighting means carrier, and a voltage converter circuit which is configured to supply the at least one LED lighting means with electrical current and whose output current can be controlled.

Embodiments and developments of the invention can, where appropriate, be combined with one another as desired. Further possible embodiments, developments and implementations of the invention also comprise non-explicitly specified combinations of features of the invention which have been described above or below with respect to the exemplary embodiments. In particular, the person skilled in the art will also add individual aspects as improvements or additions to the respective basic form of the present invention.

BRIEF DESCRIPTION OF THE DRAWINGS

The present invention will be explained in more detail below on the basis of the exemplary embodiments specified in the schematic figures. In the drawings.

The appended figures are intended to permit further understanding of the embodiments of the invention. They illustrate embodiments and serve, in conjunction with the description, to clarify principles and concepts of the invention. Other embodiments and many of the specified advantages become apparent by means of the drawings. The elements of the drawings are not necessarily shown true to scale with respect to one another. Direction-indicating terminology such as, for example, "at the top", "at the bottom", "on the left", "on the right", "above", "below", "horizontally", "vertically", "at the front", "at the rear" and similar indications are used merely for explanatory purposes and do not serve to restrict the general application to specific refinements as shown in the figures.

In the figures, identical, functionally identical and identically acting elements, features and components are each provided with the same reference symbols unless stated otherwise.

DESCRIPTION OF EXEMPLARY EMBODIMENTS

Figure 1:
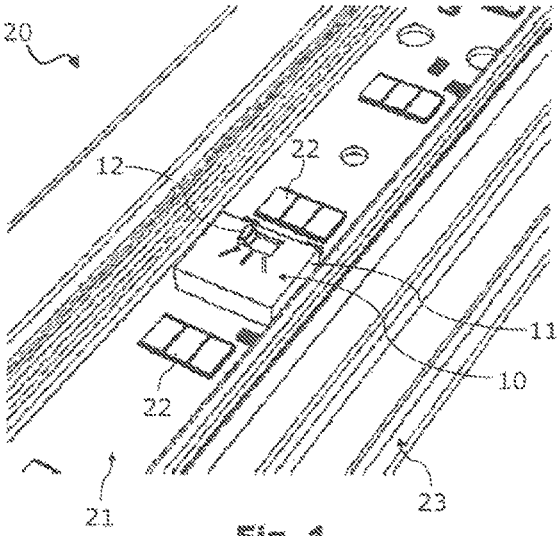
FIG. 1 shows a schematic illustration of a light having a control circuit for a voltage converter according to an embodiment of the invention.

FIG. 1 shows a schematic illustration of a light 20. The light 20 is equipped here with one or more lighting means 22 based on light-emitting diodes (LED). The LED lighting means 22 can have, for example, series circuits of LED chips which are arranged on a lighting means carrier 21. The light 20 also comprises electrical circuits which are arranged on the lighting means carrier 21 in order to supply the LED lighting means 22 with voltage.

For example, a supply voltage can be applied to the LED lighting means 22 via a voltage converter circuit (not illustrated explicitly). The voltage converter circuit is configured here to supply one or more LED lighting means 22 with electrical current. For this purpose, the output current of the voltage converter circuit can be controlled. As a result of the possibility of controlling the output current, the lighting current, which is generated by the one or more LED lighting means 22, can be set to desired values. For example, the output current of the voltage converter circuit can be adjustable to at least two discrete stages, as a result of which the LED lighting means 22 can be set to two different brightness stages. Alternatively, the output current of the voltage converter circuit can also be controllable continuously in an output current range, for example by using a potentiometer. The potentiometer can be integrated here, for example, into the lighting means carrier 21. As a result, the LED lighting means 22 can be operated with a continuously varying brightness.

In particular, the voltage converter circuit can have a rectifier, with which a power grid AC voltage can be converted into a DC voltage, and a converter with which a constant and controllable output DC current can be output at a predefined output voltage level to the LED lighting means 22. The electrical circuits can be arranged, for example, on the side of the lighting means carrier 21 facing away from the viewer in FIG. 1. The voltage converter circuit can be installed here in an electronic ballast unit, EVG, of the light 20.

The light 20 can be, for example, an LED strip here which has a generally elongate form and whose lighting means carrier 21 is embedded as a strip in a lighting means housing 23. A light cover (not explicitly illustrated), which makes the lighting means carrier 21, the LED lighting means 22 and the electrical circuits inaccessible to a user of the light 20, can be arranged above the lighting means carrier 21, flush with the lighting means housing 23.

The light 20 also has a switch 10 which is arranged in a switch housing 11 on the lighting means carrier 21 or in the vicinity of the lighting means carrier 21. The switch 10 has an actuation element 12, the actuation of which serves to set the setpoint output current of the voltage converter circuit—here a setpoint output DC current. The actuation element 12 can be embodied, for example, in such a way that it can be moved into a multiplicity of different switched positions which correlate with various values of the adjustable setpoint output DC current. For example, the actuation element 12 can be a slide which can be moved linearly to and fro in a recess of the switch housing. In this context, the actuation element 12 can be embodied in a mechanical fashion such that it can latch in the various switched positions and therefore set the setpoint output DC current. Alternatively, the actuation element 12 can also have a rotary knob, a pushbutton key, a select lever, a toggle switch, a rocker switch, a latching switch, a pull switch or a similar mechanical operator control element.

It can be advantageous if a one-way switch, which remains irreversibly activated after an operating position has been set once, is provided for the switch 10. For example, for this purpose a mechanical toothed arrangement or a latching mechanism can be arranged in the interior of a housing of the switch 10, which switch triggers an irreversible self-locking mechanism after actuation. This can be particularly advantageous if just a single setting of a brightness value at the works is desired, and no further setting possibility is to be permitted to a user of the light.

By means of the manual actuation of the actuation element 12 by a user, the user can set the light intensity means or brightness, dependent on the setpoint output DC current of the voltage converter circuit which has been set, of the LED lighting means 22 which are supplied by the voltage converter circuit. In particular, the brightness of the light 20 can therefore be adapted in situ flexibly and in accordance with the requirements by a technician during the installation of the light 20, without special precautions or presettings having to have been implemented by the manufacturer of the light. The switch 20 can be arranged here in the lighting means housing 23 in such a way that in the usual use of the light 20 it is not visible to the viewer, behind the light cover, or cannot be readily accessed. As a result, the aesthetics of the light 20 are not restricted, and at the same time the basic accessibility by an installer, electrical technician or maintenance personnel is not significantly adversely affected.

Figure 2:
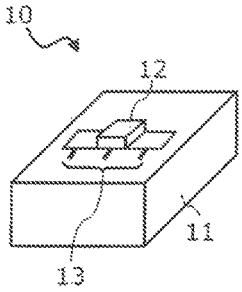
FIG. 2 shows a schematic illustration of a switch of the control circuit in FIG. 1 according to a further embodiment of the invention.

FIG. 2 shows a schematic illustration of a switch 10 such as can be installed in a light 20 in FIG. 1. The switch 10 can have a switch housing 11 which is embodied, for example, in the form of a box or right parallelepiped. It can, of course, also be possible for some other outer geometric shape to be selected for the switch housing 11, for example a shape which is adapted to a cutout in the lighting means housing 21 of the light 20.

The switch 10 also has an actuation element 12 in the form of a sliding controller. The sliding controller 12 can be connected in a recess of the switch housing 11 along an adjustment path between a plurality of switch positions. For this purpose, a scale 13 with lettering for the various switch positions can be printed or embossed on the switch housing 11.

Figure 3:
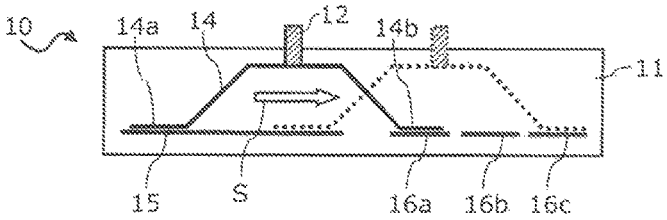
FIG. 3 shows a schematic illustration of a sectional view of the switch in FIG. 2 according to a further embodiment of the invention.

FIG. 3 shows a schematic sectional view through the switch 10 in FIG. 2. The mechanical actuation element 12, which projects from the switch housing 11 for manual movement by a user, is mechanically coupled in the switch housing 11 to a connecting bridge 14. While the mechanical actuation element 12 can be fabricated from an electrically insulating material such as, for example, plastic, the connecting bridge 14 is fabricated from an electrically conductive material, such as for example metal. The connecting bridge 14 serves as an electrically connecting lug between an input contact 15 of the switch 10, on the one hand, and a multiplicity of branch contacts 16*a*, 16*b*, 16*c*, on the other. For this purpose, the connecting bridge 14 can be configured as a sprung clamp with contact elements 14*a* and 14*b* which are embodied at both ends of the clamp and make contact in a sprung fashion and over a surface with the input contact 15 or, in each case, one of the multiplicity of branch contacts 16*a*, 16*b*, 16*c*.

As a result of a sliding movement S, the mechanical actuation element 12 can move the connecting bridge 14 to and fro in the switch housing 11 between various positions at which the contact element 14*a* electrically connects the input contact 15 via the connecting bridge 14 to, in each case, one of the branch contacts 16*a*, 16*b*, 16*c* arranged in the direction of the adjustment path of the mechanical actuation element 12. For example, a second switch position, in which the input contact 15 is electrically conductively connected to the branch contact 16*c* via the connecting bridge 14, is illustrated in a dashed illustration.

Figure 4:
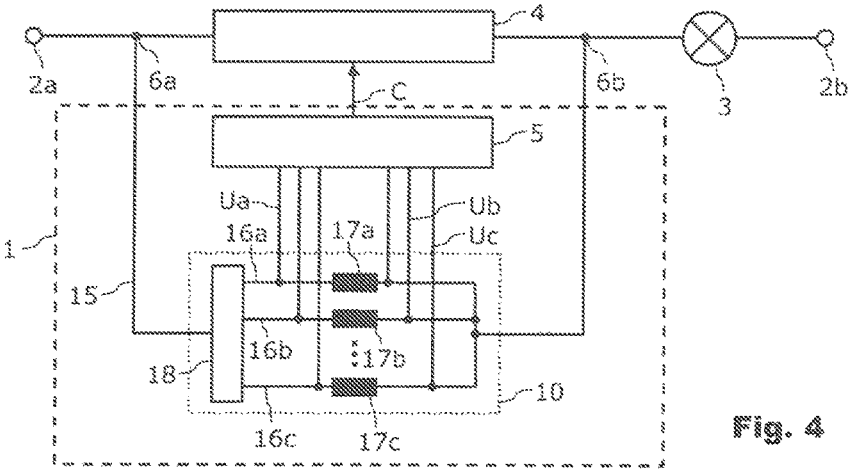
FIG. 4 shows a circuit diagram of a control circuit for a voltage converter according to a further embodiment of the invention.
Figure 5:
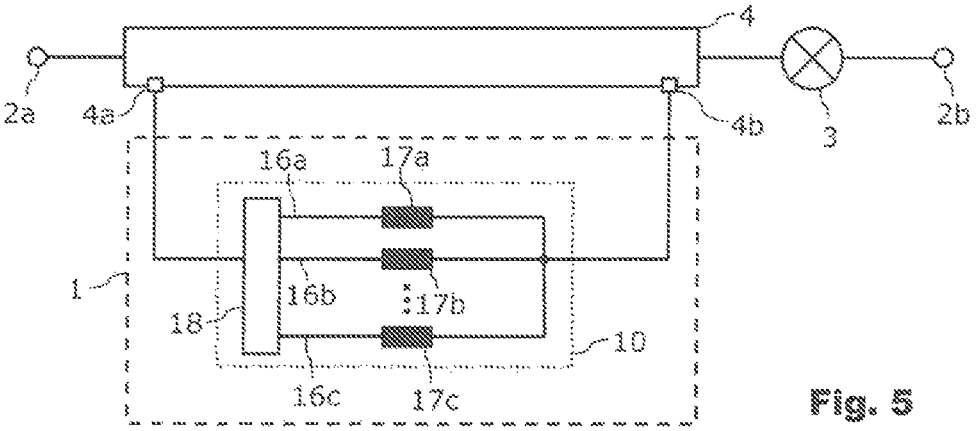
FIG. 5 shows a circuit diagram of a control circuit for a voltage converter according to a further embodiment of the invention.

The adjustable electrical connection which is provided by means of the switch 10 is shown in the circuit diagrams in FIGS. 4 and 5. FIGS. 4 and 5 each illustrate voltage converter circuits, in particular voltage converter circuits for a light 20 as explained, for example, in conjunction with FIG. 1. The voltage converter circuits each comprise here an input connection 2*a*, a voltage converter 4 which is connected to the input connection 2*a* and whose output is coupled to at least one power consumer 3, and an output connection 2*b*. The power consumer 3 can be, for example, an LED lighting means 22 or a matrix of LED lighting means 22.

For example, a DC voltage can be applied between the connections 2*a*, 2*b*. Alternatively, an AC voltage can also be applied between the connections 2*a*, 2*b*, wherein a further rectifier (not shown explicitly) can then be arranged upstream of the voltage converter 4, with the result that a DC voltage is applied between the nodes 6*a* and 6*b* in FIG. 4. The voltage converter 4 can be, for example, a converter with galvanic isolation such as, for example, a flyback converter or a push-pull converter. In principle, the type of the voltage converter 4 is, however, not limited to specific types of converter—the voltage converter 4 merely has to be designed to output a predefined setpoint output voltage at a controllable setpoint output current.

FIG. 4 shows a first variant of a voltage converter circuit. A control circuit 1 for the voltage converter 4 is connected to the nodes 6*a*, 6*b* in a parallel circuit with the voltage converter 4. The control circuit 1 comprises the switch 10 whose input contact 15 is connected to the node 6*a* between the input connection 2*a* and the input of the voltage converter 4. The switch 10 has a contact maker 18 which electrically conductively connects the input contact 15 to one of the branch contacts 16*a*, 16*b*, 16*c* as a function of the switched position of the assigned mechanical actuation element 12 (not illustrated in FIG. 4). Each of the branch contacts 16*a*, 16*b*, 16*c* forms a current-conducting branch, in each of which branches a resistor 17*a*, 17*b*, 17*c* is arranged. The resistors 17*a*, 17*b*, 17*c* can be, for example, shunt resistors with different resistance values here. The current-conducting branches are again fed from the switch 10 downstream of the resistors 17*a*, 17*b*, 17*c*, into a node 6*b* between the output of the voltage converter 4 and the output connection 2*b*.

The control circuit 1 also comprises a detector circuit 5 which is configured to detect in which of the current-conducting branches a current flows, that is to say which of the branch contacts 16*a*, 16*b*, 16*c* is actively connected to the input contact 15. For this purpose, the detector circuit 5 can determine, for example, the voltage drop of the branch voltages Ua, Ub, Uc across the respective (shunt) resistors 17*a*, 17*b*, 17*c*. Depending on the determined voltage drop of the branch voltages Ua, Ub, Uc, the detector circuit 5 can then generate an actuation signal C for the voltage converter 4, which actuation signal C sets the voltage converter 4 to a predetermined setpoint output current. The predetermined setpoint output currents which can be set by means of the actuation signal C can be adapted, in particular, to desired brightness values of the power consumer 3 which is embodied as an LED lighting means.

FIG. 5 shows a second variant of a voltage converter circuit. The voltage converter 4 has here two control inputs 4*a* and 4*b*, between which a control circuit 1 for the voltage converter 4 is connected. The control circuit 1 comprises the switch 10 whose input contact is connected to the first of the control inputs 4*a*. The switch 10 has a contact maker 18 which electrically conductively connects the first of the control inputs 4*a* to one of the branch contacts 16*a*, 16*b*, 16*c* as a function of the switched position of the assigned mechanical actuation element 12 (not illustrated in FIG. 5). Each of the branch contacts 16*a*, 16*b*, 16*c* forms a current-conducting branch, in each of which branches a resistor 17*a*, 17*b*, 17*c* is arranged. The resistors 17*a*, 17*b*, 17*c* can have, for example, different resistance values here. The current-conducting branches are again connected out of the switch 10, downstream of the resistors 17*a*, 17*b*, 17*c*, to the second of the control inputs 4*b* of the voltage converter 4.

Depending on the mechanical operating position of the switch 10, the resistance value which is applied to the branch between the two control inputs 4*a* and 4*b* of the voltage converter 4 is therefore varied. As a result of the actuation of the contact maker 18, in each case one of the multiplicity of parallel-connected current-conducting branches is coupled selectively between the two control inputs 4*a* and 4*b* of the voltage converter (4).

In both voltage converter circuits in FIGS. 4 and 5, one of the multiplicity of switched positions is selected by setting the actuation element 12 of the switch 10, with the result that the lumen flow of the light can be changed by varying the output current of the voltage converter. As a result, lights which are equipped with such control circuits 1 can be supplied in a uniform fashion from the works—the adaptation of the brightness of the light can be carried out in situ in a flexible way by means of a setting of the switch 10. In particular, electronic ballast units can be supplied in a uniform fashion from the works; this is because the adaptation of the output current can be carried out, after installation in the light, by means of the switch 10 which is integrated into the light.

In the preceding detailed description, various features for improving the stringency of the illustration have been combined in one or more examples. However, it should be clear here that the above description is merely illustrative, and is not of a restrictive nature in any way. It serves to cover all the alternatives, modifications and equivalents of the various features and exemplary embodiments. Many other examples will be clear immediately and directly to a person skilled in the art on the basis of his specialist knowledge in view of the above description.

The exemplary embodiments have been selected and described, in order to be able to present the principles underlying the invention and their application possibilities in practice as well as possible. As a result, specialist personnel can modify and use the invention and its various exemplary embodiments in an optimum way with respect to the intended purpose of use. In the claims and the description, the term "having" is used as a neutral term for the corresponding term "comprising". Furthermore, a use of the terms "a", an and one is not intended to basically exclude a multiplicity of features and components which are described in such a way.

What is claimed is:

1. A light comprising:

a lighting means carrier;

at least one LED lighting means which is arranged on the lighting means carrier; and a voltage converter circuit which is configured to supply the at least one LED lighting means with electrical current and whose output current is controlled, wherein the voltage converter circuit includes a voltage converter that is connected in series with the at least one LED lighting means and the at least one LED lighting means is supplied with electrical voltage by the voltage converter, and a control circuit having a switch which is configured to output, depending on the mechanical operating position of the switch, an actuation signal for setting a setpoint output current of the voltage converter, wherein the switch includes a multiplicity of current-conducting branches that are connected in parallel and have resistors with different resistance values, and a contact maker, wherein the contact maker is configured to connect selectively in each case one of the multiplicity of parallel-connected current-conducting branches to an input contact of the switch, and a detector circuit that is configured to determine a voltage drop across the resistors and to output, as a function of the determined voltage drop, an actuation signal for setting the setpoint output current of the voltage converter.

2. The light according to claim 1, wherein the output current of the voltage converter circuit is regulated in such a way that the lighting current generated by the at least one LED lighting means is set to desired values.

3. The light according to claim 1, wherein the output current of the voltage converter circuit is set to at least two discrete stages.

4. The light according to claim 1, wherein the output current of the voltage converter circuit is regulated continuously in an output current range.

5. The light according to claim 4, wherein the output current of the voltage converter circuit is regulated continuously in the output current range by means of a potentiometer.

6. The light according to claim 1, wherein the resistors comprise shunt resistors.

7. The light according to claim 1, further comprising:

a mechanical actuation element which is mechanically coupled to the contact maker and is configured to control, depending on the mechanical operating position, the contact maker to selectively connect in each case one of the multiplicity of parallel-connected current-conducting branches to the input contact of the switch.

8. The light according to claim 1, wherein the control circuit is connected in parallel with the voltage converter.

9. The light according to claim 1, wherein the voltage converter circuit further comprises:

a control circuit which has a switch and is configured to vary, depending on the mechanical operating position of the switch, the resistance value of a resistor which is coupled between two control inputs of the voltage converter.

10. The light according to claim 9, wherein the switch further comprises:

a multiplicity of parallel-connected current-conducting branches having resistors with different resistance values, and a contact maker, wherein the contact maker is configured to couple selectively in each case one of the multiplicity of parallel-connected current-conducting branches between the two control inputs of the voltage converter.

11. The light according to claim 1, wherein the voltage converter has a DC voltage converter with galvanic isolation.

12. The light according to claim 1, wherein the switch is arranged on the lighting means carrier.

13. The light according to claim 1, further comprising:

a lighting means housing in which the lighting means carrier is arranged; and a light cover which is arranged on the lighting means housing and which makes the switch on the lighting means carrier inaccessible from the outside.

14. The light according to claim 13, also comprising:

an electronic ballast unit (EVG) in which the voltage converter circuit is arranged.

15. The light according to claim 1, wherein the output current which outputs from the voltage converter circuit comprises predefined setpoint output current values which correspond to predefinable brightness values of the at least one LED lighting means.

16. The light according to claim 1, wherein the switch has a one-way switch which remains irreversibly deactivated after an operating position has been set once.

* * * * *